United States Patent [19]

Lazaro

[11] Patent Number: 4,740,286

[45] Date of Patent: Apr. 26, 1988

[54] ELECTROPLATING BARREL

[75] Inventor: Anton Lazaro, Niles, Ill.

[73] Assignee: Hardwood Line Manufacturing Co., Chicago, Ill.

[21] Appl. No.: 34,643

[22] Filed: Apr. 6, 1987

[51] Int. Cl.[4] ..... C25D 17/20

[52] U.S. Cl. ..... 204/213

[58] Field of Search ..... 204/213

[56] References Cited

U.S. PATENT DOCUMENTS

| | | | |
|---|---|---|---|
| 2,741,463 | 4/1956 | Colclesser | 204/213 |
| 3,256,170 | 6/1966 | Nielson | 204/213 |
| 3,421,993 | 1/1969 | Lazaro | 204/213 |

*Primary Examiner*—T. M. Tufariello

*Attorney, Agent, or Firm*—Irwin C. Alter

[57] ABSTRACT

An electroplating barrel comprises a rotatable, perforated barrel for holding objects to be electroplated. The barrel defines at least one access aperture for access to its interior, plus means for imposing an electrical potential across electrolyte solution within the barrel. In accordance with this invention the access aperture has aperture-defining edges, the edges occupying planes which are at an acute angle of about 10° to 80° to the plane of the aperture they define. Accordingly, door members shaped to fit each access aperture and defining correspondingly angled edges may close the access aperture without forming significant spaces between the door members and the aperture-defining edges.

7 Claims, 1 Drawing Sheet

ELECTROPLATING BARREL

BACKGROUND OF THE INVENTION

As illustrated for example in Lazaro U.S. Pat. No. 3,421,993, electroplating barrels are well known for use in the electroplating of small objects. Basically, a typical electroplating barrel has a perforated wall, and is immersed in electrolyte solution while containing objects to be electroplated. The barrel is then rotated so that the objects tumble within the barrel, while submerged in the electrolyte solution, and while an electrical potential is placed across the electrolyte solution in a conventional manner to cause electroplating of the objects to take place.

Processes of this type are presently used in commercial operation. For example, coins may be electroplated with the use of a rotating electroplating barrel. However, as a disadvantage of the present electroplating barrels, when small, flat objects are being electroplated in this manner, it is possible for one or more of them to become wedged in a crack or space formed between the main body of the electroplating barrel and the removable plate or plates which serve to close the access aperture or apertures in the main body of the barrel. The access aperture provides access to the barrel interior for inserting and removing the objects to be plated. When a coin or other object to be plated does become wedged in a space between the barrel body and its closure door, such coin will not become properly plated. This defect on one or more coins can raise a significant suspicion that the entire lot of coins or other objects to be plated is defective, resulting in rejection of the lot by a purchaser.

One obvious solution to the problem is to provide closure doors for the access apertures of the barrel that fit well. However, this is not always easy, since the closure door can become useless if it is only a couple of thousandths of an inch too large for fitting into the access aperture. Thus, the closure door must be made at least very slightly smaller than the access aperture, and the natural size variation of fabricated items may cause the closure door to sometimes be too small, especially when one considers the natural variations in size of the closure aperture as it is manufactured. If the closure door is too small, the undesired crack or space between the door and the body of the barrel may appear somewhere about the periphery of the junction area of the two parts, creating the risk that a coin or other object to be plated may be able to slide into that crack as the barrel rotates.

Additionally, as the barrel rotates and is used, it is stressed and flexed, which can also cause slight variations in the size of the access aperture. Thus, inherently, it has been a very difficult proposition to create and hold good dimensional tolerance between access apertures of electroplating barrels and their closure doors so that, nowhere during long hours and days of operation can a space develop between the barrel and its closure door wide enough to permit a coin to slide in.

In accordance with this invention, an improvement in the design for the access aperture and closure door of an electroplating barrel is provided. The particular design is of a forgiving nature so that a tight contact seal may be generally provided about the entire junction between the edges of the access aperture and the closure door, even in the face of small, unplanned dimensional variations due to variations in the manufacture of the parts, or due to flexing or other stress of the electroplating barrel. Thus, the operator can be confident that small, flat objects to be electroplated will not find their way in between a gap between the electroplating barrel and its closure doors, when the doors are properly closed.

DESCRIPTION OF THE INVENTION

In this invention an electroplating barrel comprises a rotatable, perforated barrel for holding objects to be electroplated. The barrel defines access aperture means for access to its interior, plus means for imposing an electrical potential across electrolyte solution within the barrel.

In accordance with this invention, the access aperture means has aperture-defining edges, the edges occupying planes which are at an acute angle of about 10° to 80° to the plane of the aperture they define.

As the result of this, door members which are shaped to fit each aperture of the access aperture means, and which define correspondingly angled edges, may close the access aperture means without forming significant spaces between the door members and the aperture-defining edges. It should be understood that with the design of access aperture and door member in accordance with this invention, if a space between the edges of the access aperture and the door member exists, the door member is generally able to be further advanced in such a manner that the space is closed, and good contact between the two members is achieved, this being accomplished because of the acute angle relationship described above of the edges of the access aperture means and the door members.

At least one access aperture is present, although multiple access apertures may be provided as shown in the drawings. Correspondingly, at least one door member is provided, typically one for each access aperture.

Preferably, the aperture-defining edges of each access aperture face inwardly relative to the barrel. The angled edges defined by the door member, in that circumstance, face outwardly relative to the barrel, in engaging relation with the aperture-defining edges.

Retaining means are preferably provided for holding the door member in its engaging relation with the electroplating barrel. It is preferable for the retaining members to extend outwardly from the door member for ease of access and for manual locking and unlocking. It can also be noted that, when the angled edges are as described immediately above, the door members cannot be pulled outwardly from their seated relationship with the barrel. They are loosened by being pushed inwardly, twisted, and then drawn out again through the access aperture.

Typically, the retaining means for holding the door member may comprise a pivotally mounted bar carried on the door member, with the door members being of rectangular shape and having first, opposed sides longer than second, opposed sides, the access aperture being of similar shape. The bar described above is longer than the second, opposed sides and shorter than the first, opposed sides, so that the bar may be rotated into engagement with the second opposed sides for retaining of the door member in locked configuration, and it may be rotated into generally parallel relation with the second, opposed sides so as not to engage them, and to permit removal of the door member.

The door member, like the wall of the electroplating barrel, may have apertures to permit the inflow and outflow of electrolyte solution. The pivotally mounted bar described above may then be of U-shaped cross section, the arms of the U-shaped cross section pointing inwardly relative to the barrel, to provide a flow channel for access to perforations which would otherwise be blocked by the bar.

DESCRIPTION OF SPECIFIC EMBODIMENTS

Figure 1:
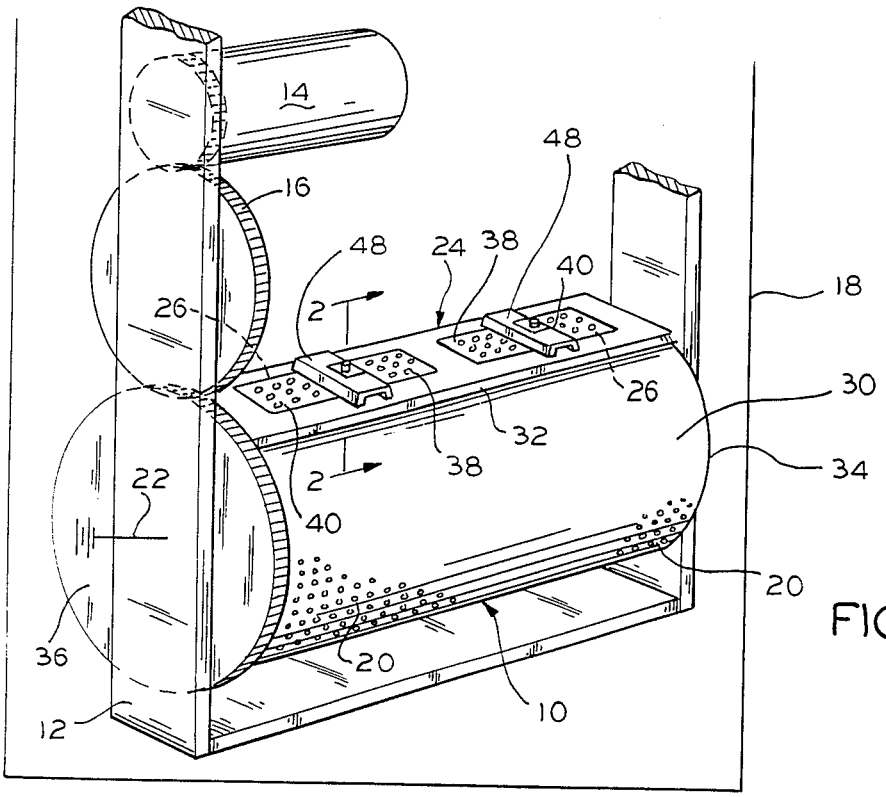
FIG. 1 is a fragmentary, perspective view of the electroplating barrel of this invention, showing the barrel in operating position.

Referring to the drawings, electroplating barrel 10 is shown to be rotatably journalled in a cradle member 12 to permit its rotation, as driven by rotatable arm 14 through intermediate gear 16. Electroplating barrel 10 may reside in a container 18 which is filled with a sufficient amount of electrolyte solution of conventional design to permit the interior of barrel 10 to be substantially filled with such solution, the solution passing into barrel 10 through perforations 20 in the wall thereof. An electrical potential may be applied through conductor 22 in conventional manner to the interior of electroplating barrel 10 in accordance with known design, for providing electroplating action to small articles within the barrel.

The specific design of barrel 10 carries an aperture housing 24 which, in this particular embodiment, defines a pair of rectangular access apertures 26. The edges 28 of housing 24 may be secured to the remainder of electroplating barrel wall 30, which is shown to comprise a cylindrical section wall portion of perforated polypropylene or other plastic sheeting, which includes an aperture into which aperture housing 24 resides, with the edges 32 of wall portion 30 being secured by adhesive or any other desired means to edges 28 of housing 24. Both ends 34, 36 of barrel 10 are sealed, with end 36 comprising a geared plate for engagement with intermediate gear 16 to facilitate rotation of barrel 10 during operation.

Figure 2:
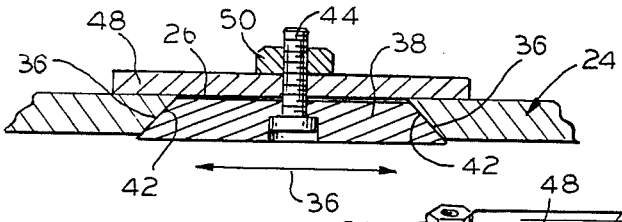
FIG. 2 is a sectional view taken along line 2—2 of FIG. 1.
Figure 3:
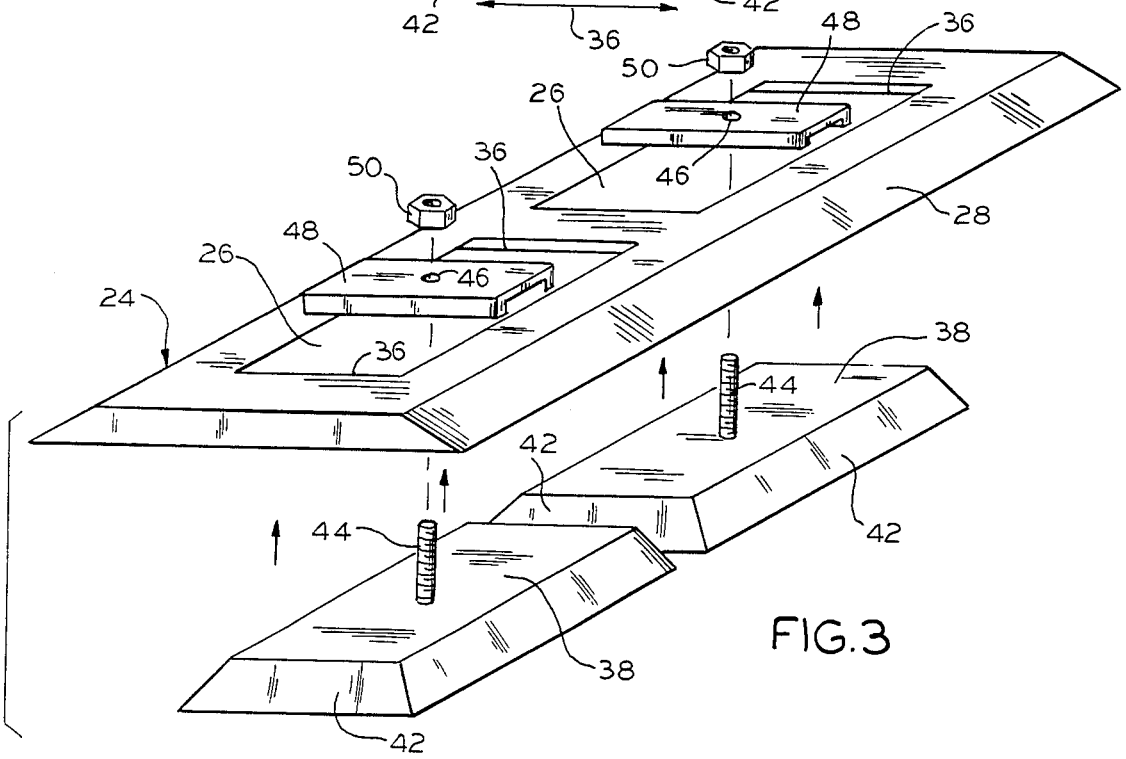
FIG. 3 is an exploded, fragmentary, perspective view of a portion of the barrel of FIG. 1 and the access door members.

FIG. 3 shows the device for sealing access apertures 26 in separated, exploded relation, while FIGS. 1 and 2 show the access apertures in sealed condition. From FIG. 2, it can be seen that each access aperture 26 is defined by aperture-defining edges 36 of housing 24. All of edges 36, entirely around aperture 26, are shown to be acutely angled with respect to the plane of aperture 26 that they define, such plane being defined by arrow 38 in FIG. 2. It can be seen that, specifically, edges 36 in this specific embodiment are shown to define an angle on the order of 45° to plane 38, and the faces of edges 36 face inwardly toward the interior of barrel 10.

Door members 38, having perforations 40, may be made of rigid pieces of plastic, being sized to fit the dimensions of access apertures 26 as shown. The edges 42 surrounding each door members may be correspondingly angled, as shown in FIG. 2, so as to mate in substantially sealing relation with edges 36. It is not absolutely necessary for the angles of the respective edges 36, 42 to be absolutely identical, but it is generally preferable that they be close so as to fit snugly together, this snug fit perferably extending around the entire perphery of the engaging edges 36, 42.

For securance of door members 38, a bolt 44 is shown to be mounted in an aperture of door member 38. Bolt 44 may extend through aperture 46 of rotatable bar 48, which may be seen to be longer than the minor axis of rectangular aperture 26, but shorter than the major axis of rectangular aperture 26. Thus, when retained on bolt 44 by lock nut 50, bar 48 is rotatable into a position locking door members 38 into engagement in apertures 28, but they may be removed by rotating bars 48, followed by moving door members 38 into the interior of drum 10, rotating them, and removing them edgewise through the respective apertures 26.

Rotatable bars 48 may be seen to be of of U-shaped cross section, with the arms of said U-shaped cross-section pointing inwardly relative to said barrel. Thus, perforations 40 in door member 48 which would otherwise be obstructed may be opened, for better flow of electrolyte solution into and out of the interior of barrel 10.

By means of the angled edges 36, 42 as used in this invention, it can be seen that the entire design of the access means of this invention is improved over the prior art, in that spaces between the joint of the closed door member and the access aperture periphery may be eliminated. Even though there may be dimensional variation between the respective parts, or even changes of dimension due to flexing and stretching, door member 38 can be expected to seat tightly and reliably in its aperture 26, with door member 38 being advanceable outwardly through a range of positions until it is well seated without any gaps. This is simply accomplished by tightening nut 50 on bolt 44, and eliminates the prior problem of flat objects for electroplating becoming wedged in a gap between a door member and the remainder of the electroplating barrel. Preferably the angles of edges 36, 42 to the plane of aperture 36 is about 20° to 80°, typically 30° to 60°.

The above has been offered for illustrative purposes only, and is not intended to limit the scope of the invention of this application, which is as defined in the claims below That which is claimed is:

1. In an electroplating barrel which comprises a rotatable, perforated barrel for holding objects to be electroplated, said barrel defining access aperture means for access to its interior, means for imposing an electrical potential across electrolyte solution within said barrel, door means positionable to close said access aperture means without forming significant spaces between said door means and the aperture means, the improvement comprising, in combination:

said access aperture means having aperture-defining edges, said edges occupying planes which face inwardly relative to said barrel and they are at an acute angle of about 10° to 80° to the plane of the aperture they define, and retaining means for holding said door means in engaging relation with said aperture defining edges to close said access aperture means, said door means being of rectangular shape and having first, opposed sides longer than second opposed sides, said door means defining angled edges that face outwardly relative to said barrel in engaging relation with said aperture defining edges, whereby door means shaped to fit said aperture means of the access aperture means, and defining correspondingly angled edges, may close said access aperture means without forming significant spaces between said door means and the aperture-defining edges.

2. The electroplating barrel of claim 1 in which retaining means are provided for holding said door member in said engaging relation, said retaining means extending outwardly from said door member.

3. The electroplating barrel of claim 2 in which said retaining means comprises a pivotally mounted bar carried on said door member, said door member being of rectangular shape and having first, opposed sides longer than second, opposed sides, said bar being longer than the second, opposed sides and shorter than the first, opposed sides.

4. In an electroplating barrel which comprises a rotable, perforated barrel for holding objects to be electroplated, said barrel defining access aperture means for access to its interior, means for imposing an electrical potential across electrolyte solution within said barrel, door means positionable to close said access aperture means without forming significant spaces between said door means and the aperture means, the improvement comprising, in combination:

said access aperture means having aperture-defining edges, said edges occupying planes which face inwardly relative to said barrel and they are at an acute angle of about 10° to 80° to the plane of the aperture they define, and retaining means for holding said door means in engaging relation with said aperture defining edges to close said access aperture means comprising a pivotally mounted bar carried on said door means, said door means being of rectangular shape and having first, opposed sides longer than second opposed sides, said bar being longer than the second opposed sides and shorter than the first opposed sides, whereby door means shaped to fit each aperture of the access aperture means, and defining correspondingly angled edges, may close said access aperture means without forming significant spaces between said door means and the aperture-defining edges.

5. The electroplating barrel of claim 4 in which said bar is of U-shaped cross-section, the arms of said U-shaped cross-section pointing inwardly relative to said barrel.

6. The electroplating barrel of claim 5 in which said door member is perforated.

7. The electroplating barrel of claim 6 in which means for rotating said barrel are provided, said barrel being submerged in electrolyte solution.

* * * * *